US006437249B1

(12) United States Patent
Higashiura et al.

(10) Patent No.: US 6,437,249 B1
(45) Date of Patent: Aug. 20, 2002

(54) MULTILAYER INSULATED WIRE AND TRANSFORMER USING THE SAME

(75) Inventors: Atsushi Higashiura; Isamu Kobayashi; Naoyuki Chida; Kunihiko Mori, all of Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/319,365

(22) PCT Filed: Oct. 5, 1998

(86) PCT No.: PCT/JP98/04491

§ 371 (c)(1),
(2), (4) Date: Jun. 4, 1999

(87) PCT Pub. No.: WO99/18583

PCT Pub. Date: Apr. 15, 1999

(30) Foreign Application Priority Data

Oct. 6, 1997 (JP) ..... 9-272964

(51) Int. Cl.[7] ..... H01B 9/02
(52) U.S. Cl. ..... 174/120 R
(58) Field of Search ..... 174/120 R, 120 SR, 174/121 A, 121 SR, 137 B

(56) References Cited

U.S. PATENT DOCUMENTS

| | | | | |
|---|---|---|---|---|
| 4,820,761 A | * | 4/1989 | Saito et al. | 524/456 |
| 4,895,913 A | * | 1/1990 | Saito et al. | 525/471 |
| 5,253,317 A | * | 10/1993 | Allen et al. | 174/121 A X |
| 5,606,152 A | | 2/1997 | Higashiura et al. | 174/120 R |
| 5,654,095 A | * | 8/1997 | Yin et al. | 174/120 R |
| 5,861,578 A | * | 1/1999 | Hake et al. | 174/120 R |

FOREIGN PATENT DOCUMENTS

| | | |
|---|---|---|
| JP | 49-76278 | 10/1947 |
| JP | 57-2361 | 1/1982 |
| JP | 63-29411 | 2/1988 |
| JP | 2-504201 | 11/1990 |
| JP | 3-56112 | 5/1991 |
| JP | 5-33411 | 4/1993 |
| JP | 6-57145 | 3/1994 |
| JP | 10-134642 | 5/1998 |

OTHER PUBLICATIONS

Hawley, "Condensed Chemical Dictionary" pp. 774–775, 1981.*

* cited by examiner

*Primary Examiner*—Chau N. Nguyen
(74) *Attorney, Agent, or Firm*—Birch, Stewart, Kolasch & Birch, LLP

(57) ABSTRACT

A multilayer insulated wire has two or more extrusion-coating insulating layers provided on a conductor directly or via some other layer, or provided on the outside of a multicore wire composed of conductor cores or insulated cores that are collected together, wherein at least one of the insulating layers is made of a mixture prepared by mixing 100 parts by weight of a polyethersulfone resin and 10 to 100 parts by weight of an inorganic filler. A transformer utilizes the multilayer insulated wire. The multilayer insulated wire can realize such high heat resistance as heat resistance F class (155° C.), which satisfies IEC 950 standards, or higher heat resistance, in transformers; and can exhibit excellent electrical properties even at high frequencies. Further, when the transformer is used at high frequencies, the electric properties are not lowered, and influence by the generation of heat can be prevented.

15 Claims, 3 Drawing Sheets

MULTILAYER INSULATED WIRE AND TRANSFORMER USING THE SAME

This application is the national phase under 35 U.S.C. § 371 of PCT International Application No. PCT/JP98/04491 which has an International filing date of Oct. 5, 1998, which designated the United States of America.

TECHNICAL FIELD

The present invention relates to a multilayer insulated wire having two or more insulating layers, and a transformer wherein the same is utilized. More specifically, the present invention relates to a multilayer insulated wire having excellent heat resistance and high-frequency properties and useful as a lead wire and a winding used in a transformer to be incorporated in electronic/electrical equipment and the like. The present invention also relates to a transformer that utilizes the multilayer insulated wire.

BACKGROUND ART

The structures of transformers are stipulated, for example, in IEC standards (International Electrotechnical Communication Standards), Pub. 950. These standards stipulate, for example, that, in the windings, the enamel film coating the conductor is not recognized as an insulating layer; an insulator having a stipulated thickness, or a thicker insulator, is to be inserted between the primary winding and the secondary winding; or, a three-layer insulator, wherein, out of the three layers, two arbitrary layers pass the test of the stipulated withstand voltage (in the case of an operating voltage of 1,000 V, they should withstand for 1 min or more with 3,000 V being applied), is to be inserted between the primary winding and the secondary winding; and a stipulated creeping distance is to be taken between the primary winding and the secondary winding.

Accordingly, in the currently predominant transformer, wherein an enameled wire is used, the structure shown in FIG. 2 in cross section, for example, is employed. That is, the structure is such that insulating barriers (2), for securing a creeping distance, are arranged on opposite ends of the circumferential surface of a bobbin (1); a primary winding (3) is wound between the insulating barriers; an insulating tape (4) is wound thereon at least three times; and then insulating barriers (2), for securing a creeping distance, are arranged on opposite ends of the circumferential surface, and a secondary winding (5) is wound between them.

Additionally, in recent years, in place of the transformer having the structure shown in FIG. 2, a transformer having the structure shown in FIG. 1 in cross section, for example, has begun to appear. The feature of this transformer hasan overal is that it is small zize ,by omitting the insulating barriers (2) and the insulating tape (4), by using an insulated wire having at least three insulating layers as the primary winding (3) and/or the secondary wire (5). In the example shown in FIG. 1, the primary winding (3) has three insulating layers (3*b*, 3*c*, and 3*d*) on the outer circumferential surface of a conductor (3*a*). This structure brings about an advantage that the number of steps of operations for winding the insulating barrier (2) and the insulating tape (4) can be reduced/omitted.

Known of such a three-layer insulated wire include are one in which a first insulating layer is formed by winding an insulating tape around the outer circumference of a conductor, and then another insulating tape is wound around thereon, to form a second insulating layer, and then a third insulating layer is formed thereon; and one in which, instead of the insulating tapes, a fluororesin is successively extruded onto the outer circumference of a conductor, to form three insulating layers in all (JU-A-3-56112("JU-A" means unexamined published Japanese utility model application)).

However, the insulation by the above insulating tape winding cannot avoid the winding operation, and therefore it has the problem that the productivity is tremendously low, to increase the production cost. Further, although the above insulation with a fluororesin is excellent in heat resistance and high-frequency properties, the cost of the resin is high, and further, when the conductor is pulled at a high shear rate, the state of the external appearance characteristically deteriorates. Therefore it is difficult to increase the production speed, leading to the fault that the cost of the electric wire with the fluororesin is made very high, similar to the insulating tape winding, and the production cost of the transformer is increased as a result. To solve such problems, the inventors of the present invention proposed, for example, an insulated wire in which a polyester resin that is modified so that crystallization may be prevented from occurring and reduction of the molecular weight may be suppressed, is extruded onto the outer circumference of a conductor, to form a first and a second insulating layer, and then a polyamide resin is extruded as a third insulating layer for the covering (JP-A-6-22334 ("JP-A" means unexamined published Japanese patent application (U.S. Pat. No. -A-5,152)).

However, it cannot be said that such a multilayer extrusion-coating insulated wire satisfactorily meets the demand for improvement in the performance of transformers in the future, which will become more and more strict.

First, as electrical/electronic equipments have been made small-sized in recent years, the influence of heat generation on a transformer becomes remarkable therefore, even in the case of the above three-layer extrusion coating insulated wire, higher heat resistance is demanded. Further, the frequency used in circuits of transformers are into high frequencies, and therefore improvements in electrical properties at high frequencies are demanded.

To meet such demands, the inventors of the present invention proposed, as a multilayer insulated wire improved in heat resistance, an electric wire covered with an inner layer of a polyethersulfone and the outermost layer of a polyamide (JP-A-10-13442).

An object of the present invention is to provide a multilayer insulated wire that solves the above problems involved in conventional multilayer insulated wires, that realizes such high heat resistance as heat resistance F class (155° C.), which satisfies IEC 950 standards, or;

higher heat resistance, in transformers; and that can exhibit excellent electrical properties even at high frequencies.

Further, another object of the present invention is to provide a transformer wherein, when it is used at high frequencies, the electric properties are not lowered, and influence by the generation of heat is prevented.

Other and further objects, features, and advantages of the invention will appear more fully from the following description, taken in connection with the accompanying drawings.

DISCLOSURE OF INVENTION

In view of the above objects, the inventors of the present invention, having investigated intensively, have found that, when at least one layer out of two or more extrusion-coating insulating layers is formed by using a mixture of 100 parts by weight of a polyethersulfone resin as a favorably extrudable heat-resistant resin with 10 to 100 parts by weight of an inorganic filler, the heat resistance is further improved, the electric properties at high frequencies are improved, and , further, the heat shock resistance (crack prevention) and the solvent resistance of the coating insulating layer are improved. The present invention is completed based on the above findings.

That is, according to the present invention there is provided:

(1) A multilayer insulated wire having two or more extrusion-coating insulating layers provided on a conductor directly or via some other layer, or provided on the outside of a multicore wire composed of conductor cores or insulated cores that are collected together, wherein at least one of the insulating layers is made of a mixture prepared by mixing 100 parts by weight of a polyethersulfone resin and 10 to 100 parts by weight of an inorganic filler;

(2) A multilayer insulated wire having two or more extrusion-coating insulating layers provided on a conductor directly or via some other layer, or provided on the outside of a multicore wire composed of conductor cores or insulated cores that are collected together, wherein at least one of the insulating layers is made of a mixture prepared by mixing 100 parts by weight of a polyethersulfone resin and 20 to 70 parts by weight of an inorganic filler;

(3) The multilayer insulated wire as stated in the above (1) or (2), wherein the insulating layer made of the mixture is formed at least as the outermost layer.

(4) The multilayer insulated wire as stated in the above (1), (2), or (3), wherein the proportion of the inorganic filler in the mixture is increased in an outer layer than an inner layer, successively.

(5) The multilayer insulated wire as stated in any one of the above (1), (2), (3), or (4), wherein the inorganic filler comprises at least one selected from among titanium oxide and silica.

(6) The multilayer insulated wire as stated in any one of the above (1), (2), (3), (4), or (5), wherein the inorganic filler has an average particle diameter of 0.1 to 5 $\mu$m.

(7) A multilayer insulated wire, comprising the multilayer insulated wire stated in any one of the above (1), (2), (3), (4), (5), or (6) whose surface is coated with a paraffin and/or a wax; and (8) A transformer, wherein the multilayer insulated wire stated in any one of the above (1), (2), (3), (4), (5), (6), or (7) is utilized.

Meanwhile, the outermost layer in the present invention refers to the layer situated farthest from the conductor out of the extrusion-coating insulating layers.

BEST MODE FOR CARRYING OUT THE INVENTION

Figure 1:
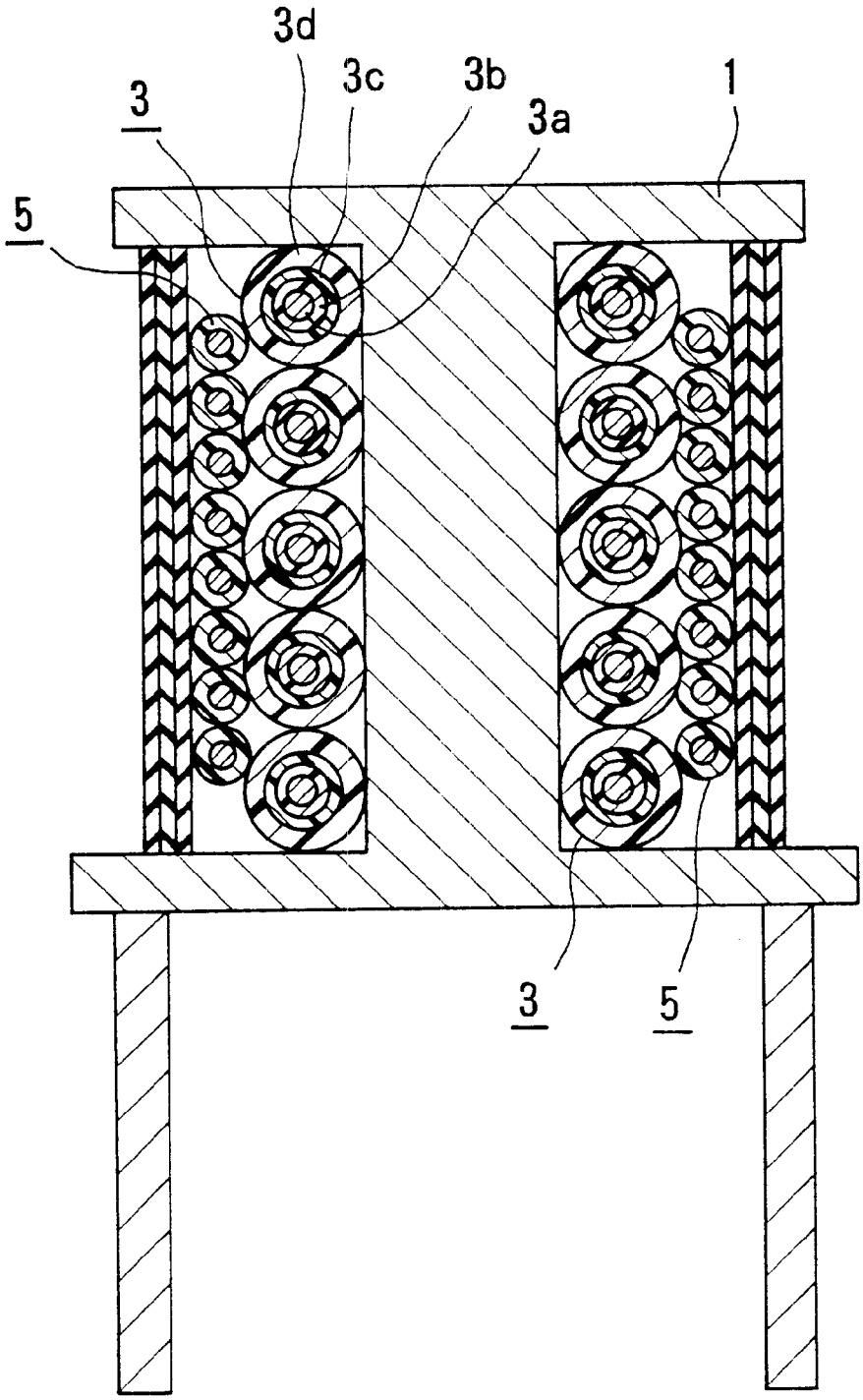
FIG. 1 is a cross-sectional view illustrating an example of the transformer having a structure in which three-layer insulated wires are used as windings.
Figure 2:
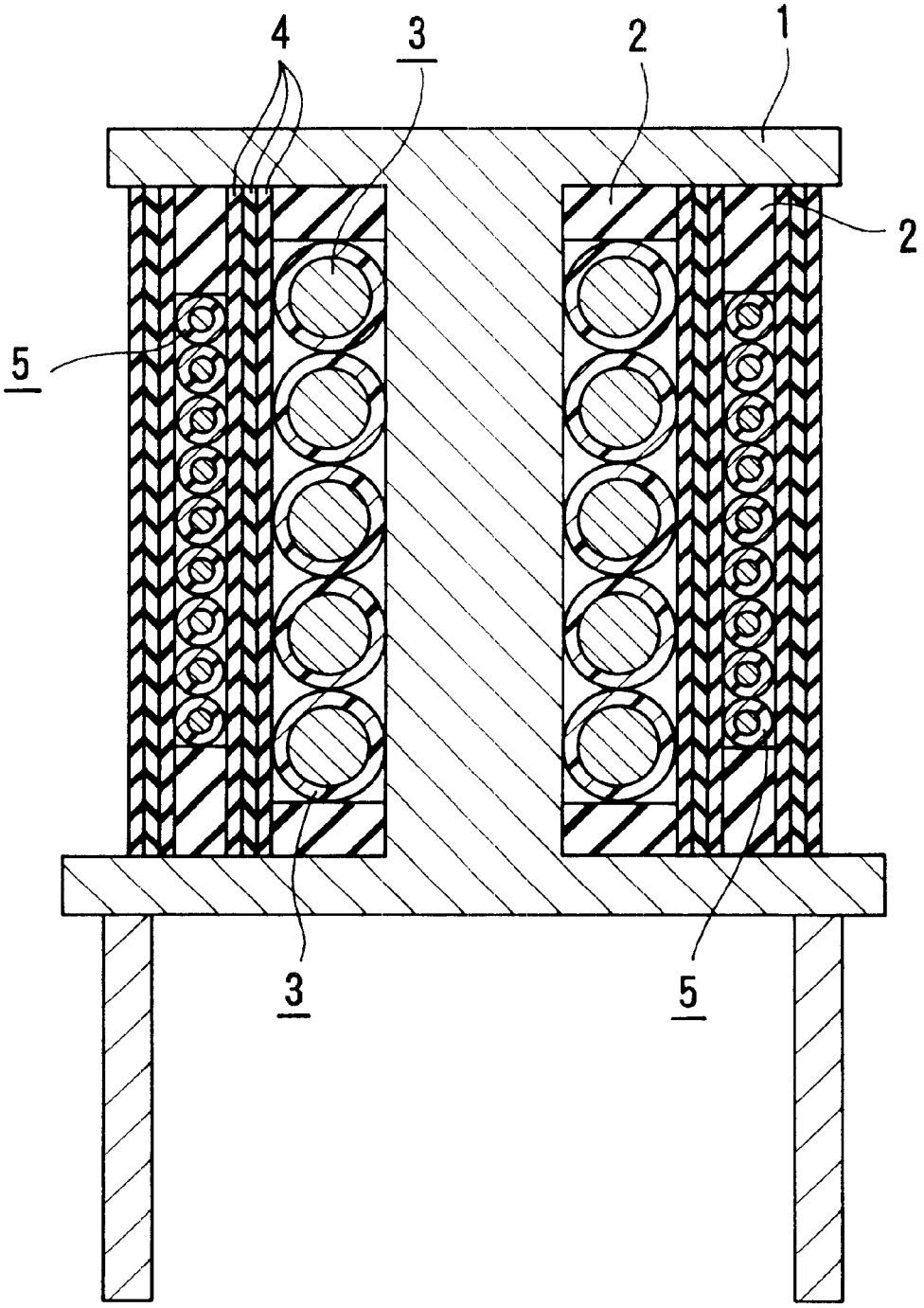
Fig. 2 PRIOR ART
FIG. 2 is a cross-sectional view illustrating an example of the transformer having a conventional structure.

The insulated wire of the present invention is characterized in that it has two or more, preferably three extrusion-coating insulating layers, and at least one layer thereof is made of a mixture of a given resin with an inorganic filler.

The resin in the mixture is a polyethersulfone resin, and the use of this polyethersulfone resin improves the heat resistance, the extrudability, and the flexibility in the function of the electric wire.

Herein, as the polyethersulfone resin for use in the present invention, can be mentioned those having the structure of the following formula (1):

formula (1)

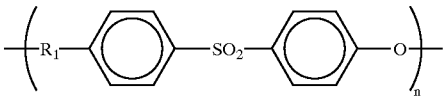

wherein $R_1$ represents a single bond or —$R_2$—O—, in which $R_2$, which may have a substituent (e.g. an alkyl group), represents a phenylene group or a biphenylylene group, and n is a positive integer large enough to give the polymer.

The method of producing this resin is known per se, and as an example, a manufacturing method in which a dichlorodiphenyl sulfone, bisphenol S, and potassium carbonate are reacted in a high-boiling solvent, can be mentioned. As commercially available resins, for example, Sumikaexcel PES (trade name, manufactured by Sumitomo Chemical Co., Ltd.), Radel A and Radel R (trade names, manufactured by Amoco) can be mentioned.

Further, the larger the molecular weight of the resin is, the more preferable it is and the more improved the flexibility in the function of the electric wire is. However, if the molecular weight of the resin is too large, it is difficult to extrude the resin into a thin film. In the present invention, the polyethersulfone resin has a reduced viscosity that is directly proportional to the molecular weight (a viscosity of a dimethylformamide solution of a polyethersulfone resin (1 g of a polyethersulfone resin (PES) in 100 ml of dimethylformamide) in a thermostat at 25° C., to be measured using a Ubbelohde's viscometer), of preferably 0.36 or more, and particularly preferably in the range of 0.41 to 0.48.

Particularly, when the amount of an inorganic filler to be used is large, it is preferable to use a polyethersulfone resin whose reduced viscosity is large, in view of flexibility of the resultant insulted wire.

In the insulated wire of the present invention, an insulating layer other than the insulating layer which is made of the mixture of a polyethersulfone resin and an inorganic filler, may be made of only a resin without any inorganic filler, and such a resin is most preferably a polyethersulfone resin, in view of heat-resistance and extrudability.

Alternatively, in place of a polyethersulfone resin, a polyetherimide resin can be used to make an insulating layer, although the polyetherimide resin is inferior to the polyethersulfone resin in view of extrudability into a thin film.

The polyetherimide resin can be synthesized, for example, by solution polycondensation of 2,2'-bis [3-(3,4-dicarboxyphenoxy)-phenyl] propanediacid anhydride and 4,4'-diaminodiphenylmethane in ortho-dichlorobenzene as a solvent, and as commercially available resins, for example, ULTEM (trade name, manufactured by GE Plastics Ltd.) can be used.

Next, as the inorganic filler that can be used in the present invention, can be mentioned titanium oxide, silica, alumina, zirconium oxide, barium sulfate, calcium carbonate, clay, talc, and the like. Among the above, titanium oxide and silica are particularly preferable, because they are good in dispersibility in a resin, particles of them hardly aggregate, and they hardly cause voids in an insulating layer, as a result, the external appearance of the resulting insulating wire is good and abnormality of electrical properties hardly occurs. Preferably the inorganic filler has an average particle diameter of 0.01 to 5 μm, and more preferably 0.1 to 3 μm. If the particle diameter is too large, the external appearance of the electric wire is sometimes deteriorated because of such problems as the inclusion of voids and a decrease in the smoothness of the surface. Further, an inorganic filler high in water absorption property lowers the electric properties sometimes, and therefore an inorganic filler low in water absorption property is preferable. Herein, "low in water absorption property" means that the water absorption at room temperature (25° C.) and a relative humidity of 60% is 0.5% or less.

The commercially available inorganic filler that can be used in the present invention includes, for example, as titanium oxide, FR-88 (trade name;

manufactured by FURUKAWA CO., LTD.; average particle diameter: 0.19 μm), FR-41 (trade name; manufactured by FURUKAWA CO., LTD.; average particle diameter: 0.21 μm), and RLX-A (trade name; manufactured by FURUKAWA CO., LTD.;

average particle diameter: 3 to 4 μm); as silica, UF-007 (trade name; manufactured by Tatsumori, LTD.; average particle diameter: 5 μm) and 5X (trade name; manufactured by Tatsumori, LTD.; average particle diameter: 1.5 μm); as alumina, RA-30 (trade name; manufactured by Iwatani International Corporation; average particle diameter: 0.1 em); and as calcium carbonate, Vigot-15 (trade name; manufactured by SHIRAISHI KOGYO KAISHA, LTD.; average particle diameter: 0.15 μm) and Softon (trade name; manufactured by BIHOKU FUNKA KOGYO CO., LTD.; average particle diameter: 3 μm).

The proportion of the inorganic filler in the above mixture is 10 to 100 parts by weight, to 100 parts by weight of the above resin. If the proportion is less than 10 parts by weight, the desired high heat-resistance and high-frequency properties cannot be obtained, further the heat shock resistance becomes bad, cracks reaching the conductor cannot be prevented from occurring, and in addition the solvent resistance is poor. On the other hand, if the proportion is over 100 parts by weight, the dispersion stability of the inorganic filler and the flexibility in the function of the electric wire are conspicuously lowered, and as a result the electric properties (breakdown voltage and withstand voltage) are deteriorated. The heat shock resistance in the present invention refers to the property against heat shock due to winding stress (simulating coiling). In view of the balance among the heat resistance, the high-frequency properties, the heat shock resistance, the solvent resistance, and other desired electric properties, preferably the proportion of the inorganic filler is 20 to 70 parts by weight, and more preferably 25 to 50 parts by weight, to 100 parts by weight of the above resin.

The above resin mixture for use in the present invention can be prepared by melting and mixing by using a conventional mixer, such as a twin-screw extruder, a kneader, and a co-kneader. There is no particular restriction on the mixing temperature and the like. However, it is preferable to dry out of the resin and the inorganic filler well , so that absorber the water absorption may be 0.1% or less, respectively.

To the above mixture can be added additives, processing aids, and coloring agents, each of which are usually used, in such amounts that they do not impair the action and effects to be attained according to the present invention, to make the resin composition for extruding and coating.

In the present invention, at least one layer out of the two or more insulating layers of the insulated wire is an insulating layer made of the above mixture. The position of the insulating layer made of the above mixture is not particularly limited, and that layer may be the outermost layer or an layer other than the outermost layer.) When an insulated wire is applied with a voltage higher than a partial discharge inception voltage by any cause, surface breakage due to corona may begin from the vicinity of parts where electric wires contact to each other, which breakage occurs more intensively under high-voltage and high-frequency, making break of wire easily proceed, thereby causing the deterioration of the electric properties. Therefore, in order to prevent this phenomenon, it is preferable that the layer made of the above mixture of a polyethersulfone resin and an inorganic filler is provided at least the outermost layer (and optionally another insulating layer) in the insulated wire of the present invention. In this case, in view of the improvement, for example, in the heat resistance and the heat shock resistance, all the layers can be made of the above mixture, but in some cases, the electric properties (breakdown voltage and withstand voltage) are lowered a little. Therefore, preferably one layer or several layers out of all the layers are made of the above mixture, or the proportion of the inorganic filler is greater in an outer layer than in an inner layer. In this case, if only the outermost layer is made of the above mixture, the heat resistance, the high-frequency V-t property, the solvent resistance, and the heat shock resistance can be greatly improved, but one wherein the proportion of the inorganic filler is increased in the more outer layer is more preferable because the adhesion between the layers is improved.

Preferably, the overall thickness of the extrusion-coating insulating layers thus formed is controlled within the range of 60 to 180 μm. Particularly preferable, the overall thickness of the extrusion-coating insulating layers is in the range of 70 to 150 μm. Preferably, the thickness of each of the insulating layers is controlled within the range of 20 to 60 μm.

The multilayer insulated wire of the present invention may be provided with a covering layer having a specific function as an outermost layer of the electric wire, on the outside of the above two or more extrusion-coating insulating layers. For the insulated wire of the present invention, if necessary, a paraffin, a wax (e.g. a fatty acid and a wax), or the like can be used, as a surface-treating agent. The refrigerating machine oil used for enameled windings has poor lubricity and is liable to make shavings in the coiling operation, but this problem can be solved by applying a paraffin or a wax in the usual manner.

As the conductor for use in the present invention, a bare conductor, an insulated conductor having an enamel film or a thin insulating layer coated on a bare conductor, a multicore stranded wire composed of intertwined conductor cores, or a multicore stranded wire composed of intertwined insulated-wires that each have an enamel film or a thin insulating layer coated, can be used. The number of the intertwined wires of the multicore stranded wire (a so-called litz wire) can be chosen arbitrarily depending on the desired application. Alternatively, when the number of wires of a multicore wire is large, for example, in a 19- or 37-element wire, the multicore wire (elemental wire) may be in a form of a stranded wire or a non-stranded wire. In the non-stranded wire, for example, multiple conductors that each may be a bare wire or an insulated wire to form the element wire, may be merely gathered (collected) together to bundle up them in an approximately parallel direction, or the bundle of them may be twisted in a very large pitch. In each case of these, the cross-section thereof is preferably a circle or an approximate circle.

The multilayer insulated wire of the present invention can be used as a winding for any type of transformer, including those shown in FIG. 1. In a transformer, generally a primary winding and a secondary winding are wound in a layered manner on a core, but the multilayer insulated wire of the present invention may be applied to a transformer in which a primary winding and a secondary winding are alternatively wound (JP-A-5-152139). Further, in the transformer of the present invention, the above multilayer insulated wire may be used for both the primary winding and the secondary winding, and if the insulated wire having three-layered extruded insulating layers is used for one of the primary and the secondary windings, the other may be an enameled wire. Additionally stated, in the case wherein the insulated wire having two extruded insulating layers is used only for one of the windings and an enameled wire is used for the other, it is required that one layer of an insulating tape is interposed between the windings and an insulating barrier is required to secure a creeping distance.

The multilayer insulated wire of the present invention has such excellent actions and effects that it has high enough heat-resistance high enough to satisfy the heat resistance F class, it has high solvent-resistance, cracks due to heat shock are not formed, and, further, electric properties at high frequencies are good. The transformer of the present invention wherein the above multilayer insulated wire is utilized, can meet the requirements for electrical/electronic equipments that are increasingly made small-sized, because the transformer is excellent in electrical properties without being lowered in electric properties when a high frequency is used in a circuit, and the transformer is less influenced by generation of heat.

EXAMPLES

The present invention will now be described in more detail with reference to the following examples, but the invention is not limited to them.

Examples 1 to 9 and Comparative Examples 1 to 3

Three layers of insulating coatings made of resin mixtures having the compositions shown in Tables 1 and 2 were formed on each of the conductors shown in Tables 1 and 2, and the surface treatments shown in Tables 1 and 2 were carried out, to make multilayer insulated wires. In Example 9, the conductor was made of seven-twisted wires each covered with a polyamideimide and having a diameter of 0.15 mm and in other cases, the conductor was an annealed copper wire having a diameter of 0.4 mmϕ. The thickness of each insulating coating was 33 $\mu$m and the total thickness of all the three layers was 100 $\mu$m.

As for the thus obtained multilayer insulated wires, the following properties were tested and evaluated. The results are shown in Tables 1 and 2.

(1) Solvent Resistance

In accordance with the evaluation of JIS C $3003^{1984}$ 14.1 (2) and 15.1, after the insulated wire was immersed in xylene at 60° C. for 30 min, the presence or absence of swelling of the coating was evaluated, and the pencil hardness was measured.

(2) Dielectric Breakdown Voltage

The dielectric breakdown voltage was measured in accordance with the two-twisting method of JIS C $3003^{-1984}$ 11.(2).

(3) Heat resistance

The heat resistance was evaluated by the following test method, in conformity to Annex U (Insulated wires) of Item 2.9.4.4 and Annex C (Transformers) of Item 1.5.3 of 950-standards of the IEC standards.

Ten turns of the multilayer insulated wire were wound around a mandrel of diameter 6 mm under a load of 118 MPa. They were heated in a thermostat for 1 hour at 240° C., and then for 72 hours at 190° C., and then they were kept in an atmosphere of 25° C. and humidity 95% for 48 hours. Immediately thereafter, a withstand voltage of 3 kV was applied thereto, for 1 min. When there was no electrical short-circuit, it was considered that it passed Class F. (The judgment was made with n=5. It was considered that it did not pass the test if it was NG even when n=1.)

(4) Heat Shock Resistance The heat shock resistance was evaluated in accordance with IEC 851-6 TEST 9. After winding to the identical diameter (1D) was done, it was placed in a thermostat at 240° C. for 30 min, and when there was no cracks in the coating, it was judged good.

(5) High-Frequency V-t Property A test specimen was made in accordance with the two-twisting method of JIS C $3003^{-1984}$ 11. (2), and the life (min) until the occurrence of short-circuit at an applied voltage of 4 kV, a frequency of 100 kHz, and a pulse duration of 10 $\mu$s was measured.

Figure 3:
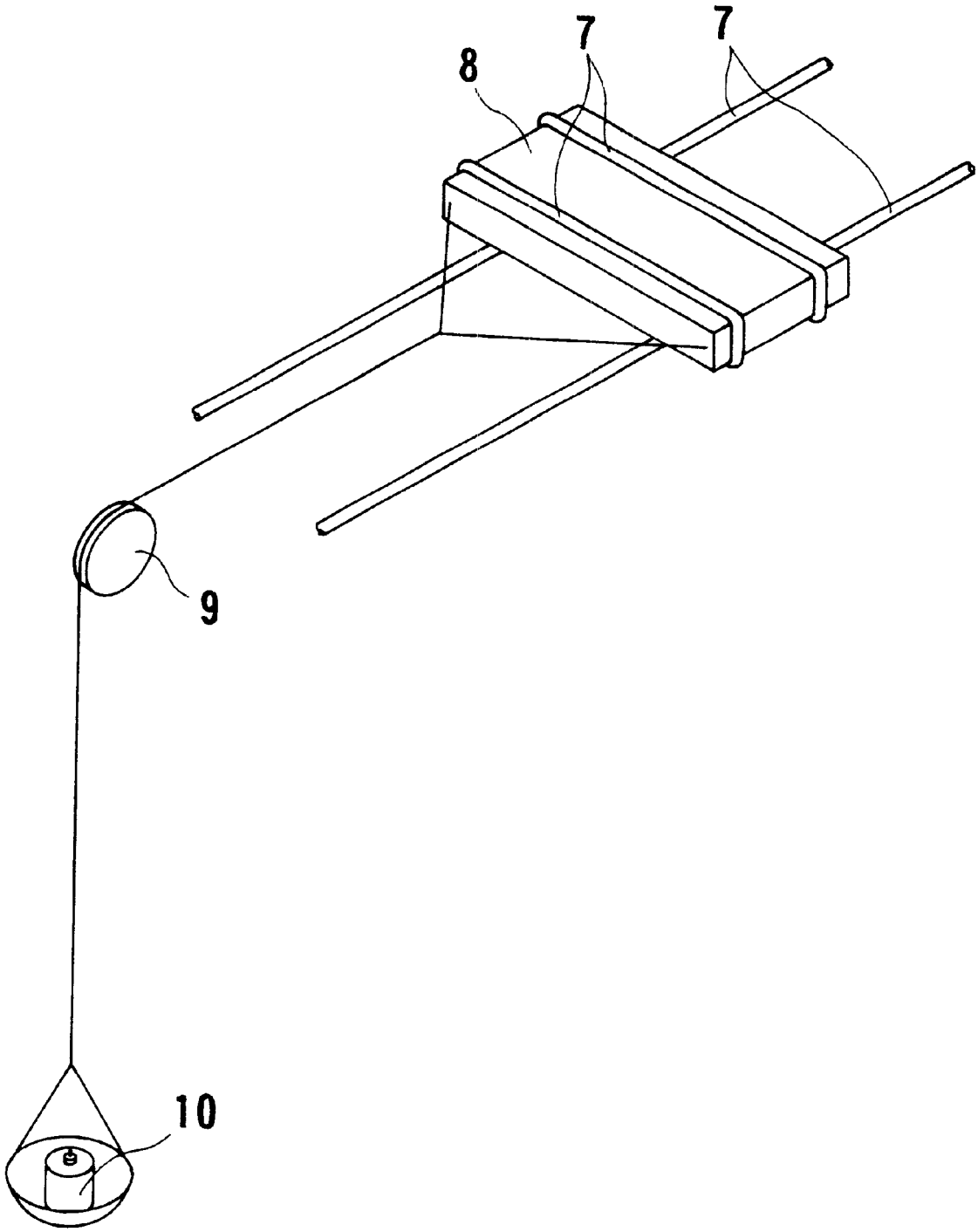
FIG. 3 is a schematic diagram showing a method of measuring static friction coefficients.

(6) Static Friction Coefficients (Coilability) The measuring was done with an apparatus shown in FIG. 3. In FIG. 3, 7 indicates multilayer insulated wires, 8 indicates a load plate, 9 indicates a pulley, and 10 indicates a load. Letting the mass of the load 10 be F (g) when the load plate 8 whose mass is W (g) starts to move, the static friction coefficient is found from F/W. The smaller the obtained numerical value is, the better the slipperiness of the surface is and the better the coilability is.

(7) Water Absorption

The water absorption was measured by a Karl Fischer's type water content measuring apparatus. The hating temperature was 200° C. Parenthetically, the materials used in Examples 1 to 9 and Comparative Examples 1 and 2 were dried to have a water absorption of 0.05% or less. The material used in Comparative Example 3 was dried to have a water absorption of 0.2%.

TABLE 1

| | | | No. | | | | | |
|---|---|---|---|---|---|---|---|---|
| | | | Example 1 | Example 2 | Example 3 | Example 4 | Example 5 | Example 6 |
| First layer | Resin | | PES*0 | PES | PES | PES | PES | PES |
| | Inorganic filler | Kind | Titanium oxide*2 | — | — | — | — | — |
| | | Proportion*1 | 65 | — | — | — | — | — |

TABLE 1-continued

| | | | No. | | | | | |
|---|---|---|---|---|---|---|---|---|
| | | | Example 1 | Example 2 | Example 3 | Example 4 | Example 5 | Example 6 |
| Second layer | Resin | | PES | PES | PES | PES | PES | PES |
| | Inorganic filler | Kind | Titanium oxide*2 | Titanium oxide*2 | Titanium oxide*2 | — | — | — |
| | | Proportion*1 | 65 | 15 | 15 | — | — | — |
| Third layer (outermost layer) | Resin | | PES | PES | PES | PES | PES | PES |
| | Inorganic filler | Kind | Titanium oxide*2 | Titanium oxide*2 | Titanium oxide*2 | Titanium oxide*2 | Titanium oxide*2 | Silica*4 |
| | | Proportion*1 | 65 | 15 | 30 | 30 | 65 | 65 |
| Surface-treatment | | | refrigerating machine oil | refrigerating machine oil | fatty acid wax | fatty acid wax | fatty acid wax | fatty acid wax |
| Solvent resistance (xylene) | | | 5H | 4H | 4H | 4H | 5H | 5H |
| Dielectric breakdown voltage (kV) | | | 16.8 | 20.9 | 21.0 | 22.5 | 21.8 | 17.5 |
| Heat resistance F class | | | passed | passed | passed | passed | passed | passed |
| Heat shock resistance | | | good | good | good | good | good | good |
| High-frequency V-t property (min) | | | 153.7 | 45.5 | 50.1 | 30.2 | 50.3 | 17.3 |
| Static friction coefficient | | | 0.15 | 0.17 | 0.10 | 0.10 | 0.10 | 0.09 |

(Note)
*0Sumikafcel PES (trade name, manufactured by Sumitomo Chemical Co., Ltd.); reduced viscosity of PES in Examples 1, 5 and 6 was 0.48, and that in Examples 2 to 4 was 0.41.
*1Weight parts to 100 weight parts of the resin
*2FR-88 (trade name, manufactured by FURUKAWA Co., Ltd.) Average particle diameter 0.19 μm
*3RLX-A (trade name, manufactured by FURUKAWA Co., Ltd.) Average particle diameter 3 to 4 μm
*4UF-007 (trade name, manufactured by Tatsumori Ltd.) Average particle diameter 5 μm

TABLE 2

| | | | No. | | | | | |
|---|---|---|---|---|---|---|---|---|
| | | | Example 7 | Example 8 | Example 9 | Comparative example 1 | Comparative example 2 | Comparative example 3 |
| First layer | Resin | | PES*0 | PES | PES | PES | PES | PES |
| | Inorganic filler | Kind | — | — | — | — | — | — |
| | | Proportion*1 | — | — | — | — | — | — |
| Second layer | Resin | | PES | PES | PES | PES | PES | PES |
| | Inorganic filler | Kind | — | — | — | — | — | — |
| | | Proportion*1 | — | — | — | — | — | — |
| Third layer most layer) | Resin | | PES | PES | PES | PES | PES | Nylon 6,6 |
| | Inorganic filler | Kind | Silica*5 | Calcium carbonate*6 | Titanium oxide*2 | — | Titanium oxide*2 | — |
| | | Proportion*1 | 65 | 65 | 65 | — | 120 | — |
| Surface-treatment | | | Paraffin | fatty acid wax | fatty acid wax | refrigerating machine oil | refrigerating machine oil | refrigerating machine oil |
| Solvent resistance (xylene) | | | 5H | 4H | 3H | swelled | 4H | 3H |
| Dielectric breakdown voltage (kV) | | | 22.6 | 21.7 | 26.7 | 22.0 | 13.2 | 20.5 |
| Heat resistance F class | | | passed | passed | passed | not passed cracked | not passed | not passed |
| Heat shock resistance | | | good | good | good | poor cracked | poor cracked | poor |
| High-frequency V-t property (min) | | | 28.7 | 19.7 | 63.9 | 10.3 | 0.2 | 0.4 |
| Static friction coefficient | | | 0.10 | 0.10 | 0.09 | 0.15 | 0.21 | 0.08 |

(Note)
*0reduced viscosity of PES in Examples 7 to 9 and Comparative example 2 was 0.48, and that in Comparative examples 1 and 3 was 0.41
*1Weight parts to 100 weight parts of the resin
*5 5X (trade name, manufactured by Tatsumori Ltd.) Average particle diameter 1.5 μm
*6Vigot-15 (trade name, manufactured by SHIRAISHI KOGYO KAISHA, LTD.) Average particle diameter 0.15 μm The multilayer insulated wires of Examples 1 to 9 passed the heat resistance F class, and in the heat shock resistance test, they were not cracked, and the solvent resistance and the chemical resistance were good.

In Example 1, the insulated wire was one wherein all the insulating layers were made of a mixture of a resin and an inorganic filler specified in the present invention, the properties including the heat resistance were good, and particularly the high-frequency V-t property was excellent.

Examples 2 and 3 were insulated wires wherein two layers including the outermost layer were made of the above mixture, and the properties were good and well balanced.

Examples 4 to 9 were insulated wires wherein only the outermost layer was made of the above mixture, the properties were good and well balanced, the dielectric breakdown voltage was high, and the high-frequency V-t property was good. The coefficient of static friction was small due to the use of a surface-treating agent, and therefore the coilability was good. In Example 6, since the particle diameter of the silica was large, the compatibility with the resin was lowered, and the dielectric breakdown voltage and the high-frequency V-t property were a little low in comparison with those of Example 5. In Example 7, silica having a small particle diameter was used, and the insulated wire was good in general. Further, in Example 8, since the water-absorption property of the inorganic filler was high, the high-frequency V-t property was a little low in comparison with that of Example 5. In Example 9, the conductor was a twisted wire of insulated wires, and the dielectric breakdown voltage and the high-frequency V-t property were particularly good.

In contrast, in Comparative Example 1, swelling of the coating was observed in the solvent resistance test, and cracks were formed in the heath-shock-resistance test as well as in the heat resistance test.

In Comparative Example 2, since the amount of the inorganic filler was too large, the flexibility in the ordinary state was much lowered, and as a result the dielectric breakdown voltage, the heat resistance, and the heat shock resistance were poor and the high-frequency V-t property was conspicuously low.

Comparative Example 3 was an insulated wire whose outermost layer was made of polyamide (nylon) 6, 6, the heat resistance was low, the heat shock resistance was poor, and the high-frequency V-t property was conspicuously low.

INDUSTRIAL APPLICABILITY

The multilayer insulated wire of the present invention is preferably suitable for use in high-frequency equipments, such as computers, parts of domestic electric equipments, and communication equipments, since it is heat-resistant high enough to satisfy the heat resistance F class, it has high solvent-resistant, cracks due to heat shock are not formed, and, further, electric properties at high frequencies are good.

Further, the transformer of the present invention wherein the multilayer insulated wire is utilized, is preferably suitable for electrical/electronic equipments that are increasingly made small-sized, because the transformer is excellent in electrical properties without being lowered in electric properties when a high frequency is used in a circuit, and the transformer is less influenced by generation of heat.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A multilayer insulated wire having two or more extrusion-coating insulating layers provided on a conductor directly or via some other layer, or provided on the outside of a multicore wire composed of conductor cores or insulated cores that are collected together, wherein at least one of the insulating layers is made of a mixture prepared by mixing 100 parts by weight of a polyethersulfone resin that has a reduced viscosity of 0.36 or more, which is the viscosity of 1 g of the polyethersulfone resin in 100 ml of dimethylformamide measured using an Ubbelohde's viscometer at a temperature of 25° C., and 10 to 100 parts by weight of at least one inorganic filler selected from the group consisting of titanium oxide and silica; and said layers have an overall thickness within the range of 60 to 180 $\mu$m.

2. The multilayer insulated wire as claimed in claim 1, wherein the insulating layer made of the mixture is formed as an outermost layer or as an outer layer other than the outermost layer.

3. The multilayer insulated wire as claimed in claim 1 wherein the proportion of the inorganic filler in the mixture is increased in an outer layer than an inner layer, successively.

4. The multilayer insulated wire as claimed in claim 3, wherein the wire is used in a transformer having a secondary winding provided on a primary winding.

5. The multilayer insulated wire as claimed in claim 1 wherein the inorganic filler has an average particle diameter of 0.1 to 5 $\mu$m.

6. The multilayer insulated wire as claimed in claim 1, whose surface is coated with at least one selected from the group consisting of a paraffin and a wax.

7. A transformer, wherein the multilayer insulated wire in claim 1, is utilized.

8. The multilayer insulated wire as claimed in claim 1, wherein the insulated wire has heat resistance of class F.

9. A multilayer insulated wire having two or more extrusion-coating insulating layers provided on a conductor directly or via some other layer, or provided on the outside of a multicore wire composed of conductor cores or insulated cores that are collected together, wherein at least one of the insulating layers is made of a mixture prepared by mixing 100 parts by weight of a polyethersulfone resin that has a reduced viscosity of 0.36 or more, which is the viscosity of 1 g of the polyethersulfone resin in 100 ml of dimethylformamide measured using an Ubbelohde's viscometer at a temperature of 25° C., and 20 to 70 parts by weight of at least one inorganic filler selected from the group consisting of titanium oxide and silica; and said layers have an overall thickness within the range of 60 to 180 $\mu$m.

10. The multilayer insulated wire as claimed in claim 9, wherein the proportion of the inorganic filler is increased in an outer layer than an inner layer, successively.

11. The multilayer insulated wire as claimed in claim 9, wherein the insulating layer made of the mixture is formed as an outermost layer or as an outer layer other than the outermost layer.

12. The multilayer insulated wire as claimed in claim 9, wherein the inorganic filler has an average particle diameter of 0.1 to 5 $\mu$m.

13. The multilayer insulated wire as claimed in claim 9, whose surface is coated with at least one selected from the group consisting of a paraffin and a wax.

14. A transformer utilizing the multilayer insulated wire of claim 9.

15. A multilayer insulated wire having two or more insulating layers provided on a conductor directly or via some other layer, or provided on the outside of a multicore wire composed of conductor cores or insulated cores that are collected together, wherein the insulating layers are coated by way of extrusion coating, and wherein at least one of the insulating layers is made of a mixture prepared by mixing 100 parts by weight of a polyethersulfone resin that has a reduced viscosity of 0.36 or more, which is the viscosity of 1 g of the polyethersulfone resin in 100 ml of dimethylformamide measured using an Ubbelohde's viscometer at a temperature of 25° C., and 10 to 100 parts by weight of at least one inorganic filler selected from the group consisting of titanium dioxide, silica, alumina, zirconium oxide, barium sulfate, clay and talc: and said layers have an overall thickness within the range of 60 to 180 $\mu$m.

* * * * *